US005913794A

United States Patent [19]

Chen

[11] Patent Number: 5,913,794

[45] **Date of Patent: *Jun. 22, 1999**

[54] DUCTILE STEEL BEAM-TO-COLUMN CONNECTION

[75] Inventor: Sheng-Jin Chen, Taipei, Taiwan

[73] Assignee: National Science Council, Taipei, Taiwan

[ * ] Notice: This patent is subject to a terminal disclaimer.

[21] Appl. No.: 08/767,911

[22] Filed: Dec. 17, 1996

[30] Foreign Application Priority Data

Nov. 21, 1996 [TW] Taiwan ..... 85114354

[51] Int. Cl.[6] ..... E04H 9/02; E04C 3/00

[52] U.S. Cl. ..... 52/729.1; 52/167.1; 52/731.1; 52/736.2; 52/737.2

[58] Field of Search ..... 52/167.1, 167.3, 52/726.1, 726.2, 729.1, 729.2, 729.3, 729.4, 729.5, 731.1, 736.2, 737.2, 740.8

[56] References Cited

U.S. PATENT DOCUMENTS

| | | | |
|---|---|---|---|
| 3,716,959 | 2/1973 | Bernardi | 52/737.2 |
| 5,148,642 | 9/1992 | Plumier et al. | 52/167.1 |
| 5,349,794 | 9/1994 | Taga | 52/167.1 |
| 5,595,040 | 1/1997 | Chen | 52/167.1 |

FOREIGN PATENT DOCUMENTS

| | | | |
|---|---|---|---|
| 827724 | 5/1981 | U.S.S.R. | 52/167.1 |
| 958639 | 9/1982 | U.S.S.R. | 52/167.1 |

*Primary Examiner*—Carl D. Friedman
*Assistant Examiner*—Laura A. Callo
*Attorney, Agent, or Firm*—Townsend and Townsend and Crew LLP

[57] ABSTRACT

A ductile steel beam-to-column connection is connected between an H-beam and a column surface. The H-beam has a pair of flange plates and a web plate positioned between the flange plates, a plastic moment capacity and a demand moment capacity. The beam-to-column connection comprises a web plate member and a pair of flange plate members. The web plate member is disposed at an end of the H-beam integrally formed with the web plate of the H-beam. The pair of flange plate members are also disposed at the end of the H-beam and respectively integrally formed with the flange plates. One of the flange plate members includes a tapered zone that is non-uniform.

7 Claims, 7 Drawing Sheets

DUCTILE STEEL BEAM-TO-COLUMN CONNECTION

BACKGROUND OF THE INVENTION

Steel structures are widely used in the construction of high-rise buildings in seismic area. The strength and ductility of steel structure not only depend on its individual members but rely on the connections between these members. From past studies, however, it has been found that brittle fracture may occur at beam-to-column connections. The fracturing of connections of steel buildings in the Northridge earthquake in 1994 and Kobe earthquake in 1995 generated concerns regarding the reliability of current design and construction technology on steel connections.

In applicant's previous invention, U.S. application. Ser. No. 08/278,034, there is provided a beam-to-column connection which has tapered zones on its flange plate members. This arrangement greatly increases the ductility of the connection in a building. In this invention, the beam-to-column connection is further modified and thereby more suitable for all buildings.

SUMMARY OF THE INVENTION

An object of the present invention is to provide a ductile steel beam-to-column connection which can be practiced in both new structures and existing structures.

In accordance with the object of the present invention, there is provided a beam-to-column connection which is connected between an H-beam and a column surface. The H-beam has a pair of flange plates and a web plate positioned between the flange plates, a plastic moment capacity and a demand moment capacity. The beam-to-column connection comprises a web plate member and a pair of flange plate members. The web plate member is disposed at an end of the H-beam integrally formed with the web plate of the H-beam. The pair of flange plate members are also disposed at the end of the H-beam and respectively integrally formed with the flange plates. One of the flange plate members includes a tapered zone that is non-uniform.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

In order to understand the following embodiments, relevant principles need to be introduced first.

Figure 1A:
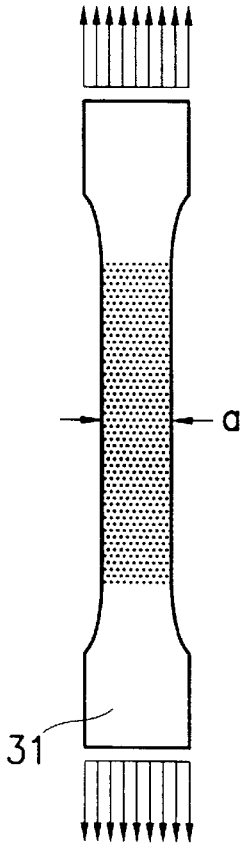
FIGS. 1A–1C show three tension coupons under uniform loads at their ends.
Figure 1B:
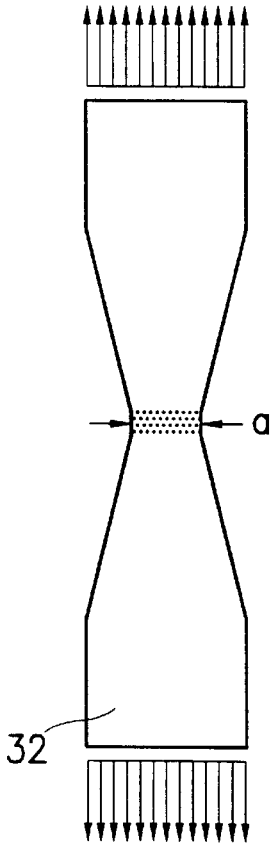
Figure 1C:
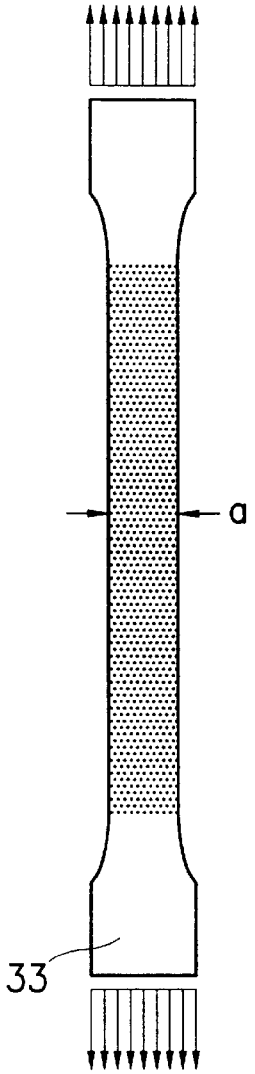

The geometry, loading type and material properties all affect the hysteresis performance of a structural member. FIGS. 1A, 1B and 1C show three tension coupons 31, 32, 33 under uniform loads at their ends. Each of the tension coupons 31, 32, 33 has the same minimum width "a" and is made of the same material. When the loads are gradually increased, the reduced sectional area of the tension coupon 31 will yield uniformly. However, the tension coupon 32 that has varying width along its length will yield around the section of minimum width only. Since the plastic deformations concentrate in a limited area, only very limited energy dissipation capacity can be expected. The deformation characteristics of the tension coupon 32 can be classified as brittle. The tension coupon 33 has the same sectional properties as the tension coupon 31 except it has a longer length of constant stress area. Hence, the tension coupon 33 possesses larger plastic volume and will dissipate larger amount of energy as compared with the tension coupon 31.

Figure 2:
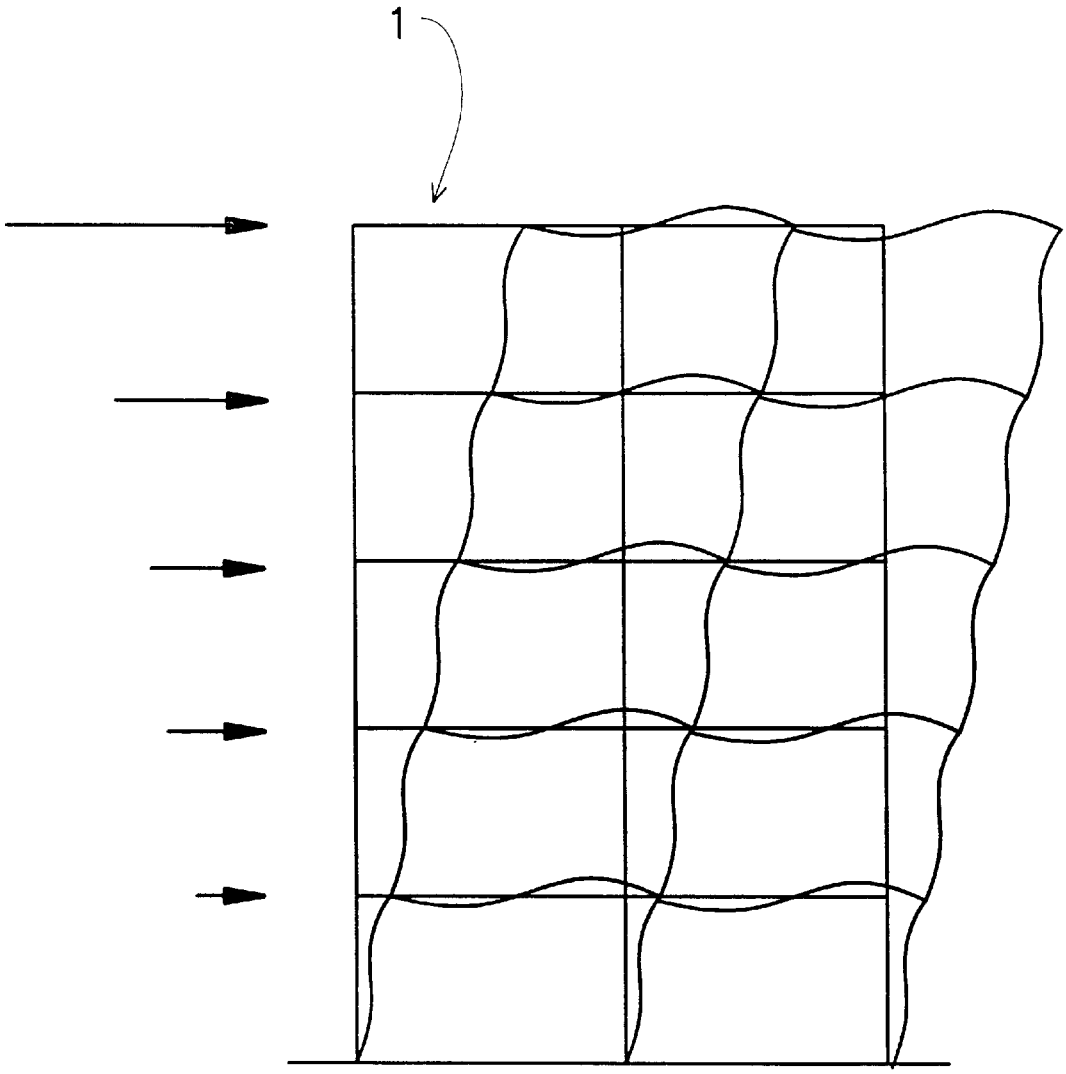
FIG. 2 is a schematic diagram of a typical moment resisting frame under earthquake loads.
Figure 3A:
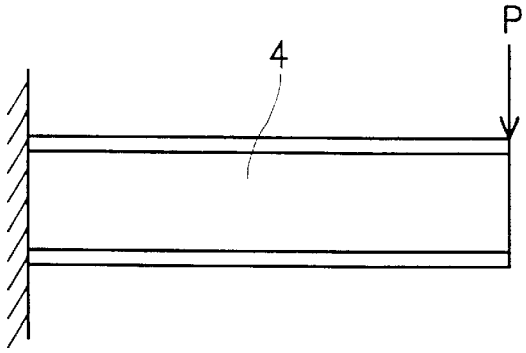
FIG. 3A shows a cantilever beam model under a concentrated load at its free end.
Figure 3B:
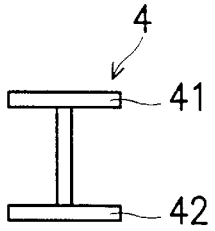
FIG. 3B shows a cross section of the cantilever beam model according to FIG. 3A.
Figure 3C:
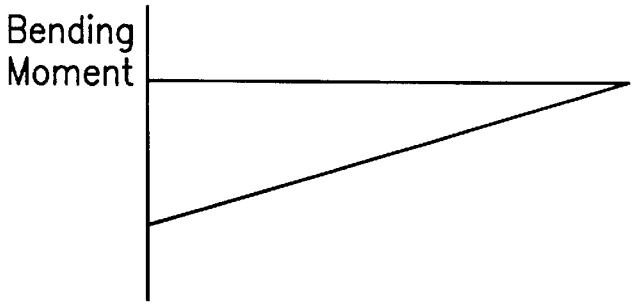
FIG. 3C is a bending moment diagram of the cantilever beam model according to FIG. 3A.
Figure 3D:
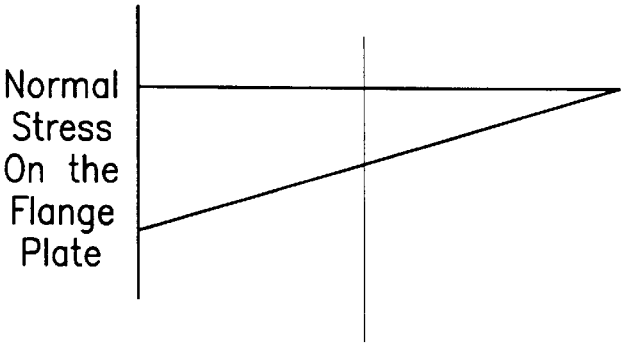
FIG. 3D is a normal stress diagram of a flange plate of the cantilever beam model according to FIG. 3A.
Figure 4:
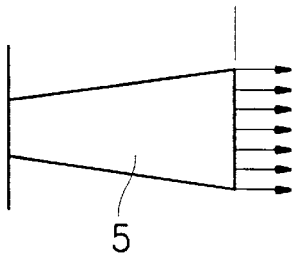
FIG. 4 shows an equivalent flange plate of the flange plate according to FIG. 3D.

Referring next to FIG. 2 through FIG. 4, for a typical moment resisting frame 1 under earthquake loads (FIG. 2), it is found that the earthquake loads are primarily resisted by the flexure behavior on the beam-to-column connections. A cantilever beam model 4 under concentrated load P at its free end (FIG. 3A) would produce the same moment gradient as the frame 1. The cantilever beam model 4 has a pair of flange plates 41, 42 (FIG. 3B) connected by a web. FIG. 3C is a bending moment diagram of the cantilever beam model 4. FIG. 3D is a normal stress diagram of the flange plate 41 of the cantilever beam model 4. The same stress state can be obtained by modeling the flange plate 41 on a plate 5 (FIG. 4) with varying width and subject to a uniform load at the far end. However, this equivalent plate 5 also simulates the situation of the tension coupon 32 shown in FIG. 1B. The tension coupon 32 has little deformation capacity and will readily brittle fracture. This phenomenon explains why the steel beam-to-column connection usually possesses limited ductility.

Figure 5:
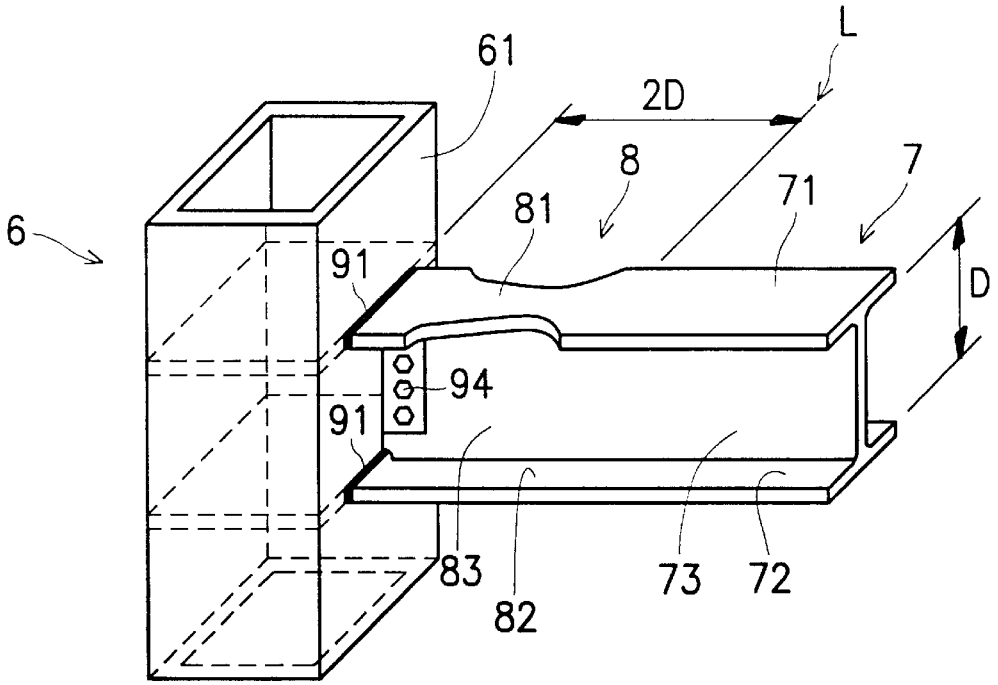
FIG. 5 is a perspective diagram of an H-beam connected to a box-column through a beam-to-column connection according to a first embodiment of this invention.

FIG. 5 is a perspective diagram of an H-beam connected to a box-column through a beam-to-column connection according to a first embodiment of this invention, wherein reference number 6 represents a box—column and reference number 7 represents an H-beam. The H-beam 7 includes a web plate 73 and a pair of flange plates 71, 72. A cross section of the H-beam is in the shape of an H because the flange plates 71, 72 are formed at the opposite sides of the web plate 73 respectively. The depth of the H-beam is D. The beam-to-column connection 8 is defined at one end of the H-beam 7 and includes a web plate member 83 and a pair of flange plate members 81, 82. In other words, the flange plate members 81, 82 and the web plate member 83 are integrally formed with the flange plates 71, 72 and the web plate 73 respectively. The connection 8 formed at the end of the H-beam 7 can be connected to the box-column 6 by welds 91 and/or bolts 94.

Figure 6:
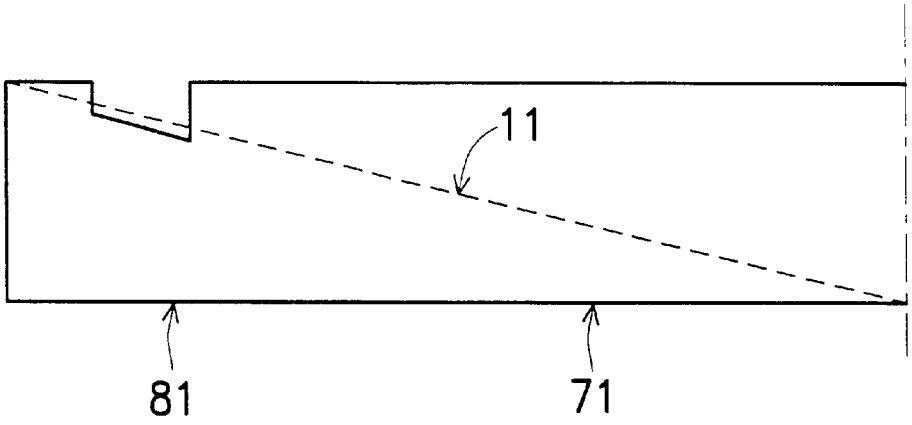
FIG. 6 indicates a demand moment capacity on the flange plate of the H-beam according to FIG. 5.

It is noted that the upper flange plate member 81 has a tapered zone. The upper flange plate member 81 is trimmed to form the tapered zone starting at a short distance from a column surface 61. This arrangement is to avoid welding defects and a deterioration of material properties in the heat effect zone. Generally speaking, the distance where the tapered zone begins from the column surface 61 is between about 5 cm and 12 cm. The end of the tapered zone will depend on the requirements and designs of a structure. According to inventor's experiences, however, the connection 8 has good performance under a situation that the tapered zone is formed "within" a region which is defined between the column surface 61 and a line L parallel to and apart from the column surface 61 at about a distance 2D (D is the beam depth). The purpose of the tapered zone is to create a finite area of plastic zone. Referring to FIG. 6, a dotted line 11 indicates moment gradient (or demand moment capacity) of the beam member. The tapered zone of the flange plate member 81 is cut according to the moment gradient that would produce an enlarged plastic area. In this embodiment, the flange plate member 81 of the connection 8 is tapered to reduce the provided strength (the plastic moment capacity) equal to or a little less than the demand moment capacity. To reduce the plastic moment capacity equal to the demand moment capacity means the flange plate member 81 is cut along the dotted line 11. However, setting the plastic moment capacity at the tapered area to be a little less than the demand moment capacity (as shown in FIG. 6) ensures that the plasticity occurs in the tapered area, and avoids failure at the column surface 61 where welding may have deteriorated the material.

The tapered zone essentially forms a "uniform stress" region in the flange plate member 81 which reduces the plastic moment capacity of the beam member to about 90% to 95% of the demand moment capacity of the beam member. This renders the connection 8 between the H-beam 7 and the box column 6 less brittle and increases the plastic rotational capacity of the connection 8.

Figure 7:
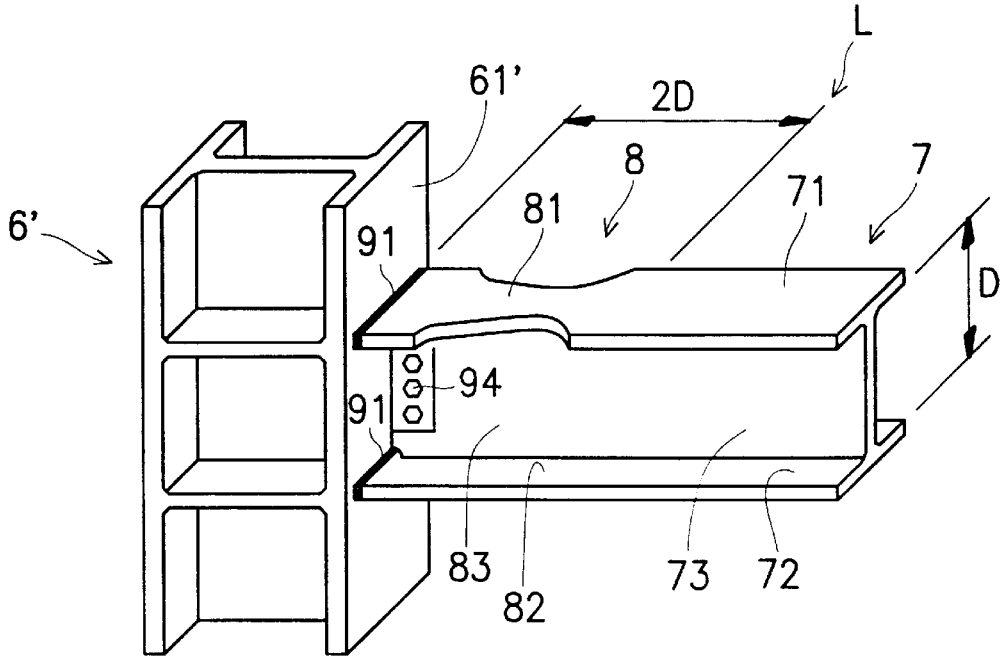
FIG. 7 is a perspective diagram of an H-beam connected to an H-column through a beam-to-column connection according to an alternative first embodiment of this invention.

A beam-to-column connection according to this invention is also suitable for connecting an H-beam to an H-column. As shown in FIG. 7, reference number 6' represents an H-column and reference number 61' is its surface. By welding and/or bolting, the connection 8 of the H-beam 7 is connected to the H-column 6'.

Figure 8:
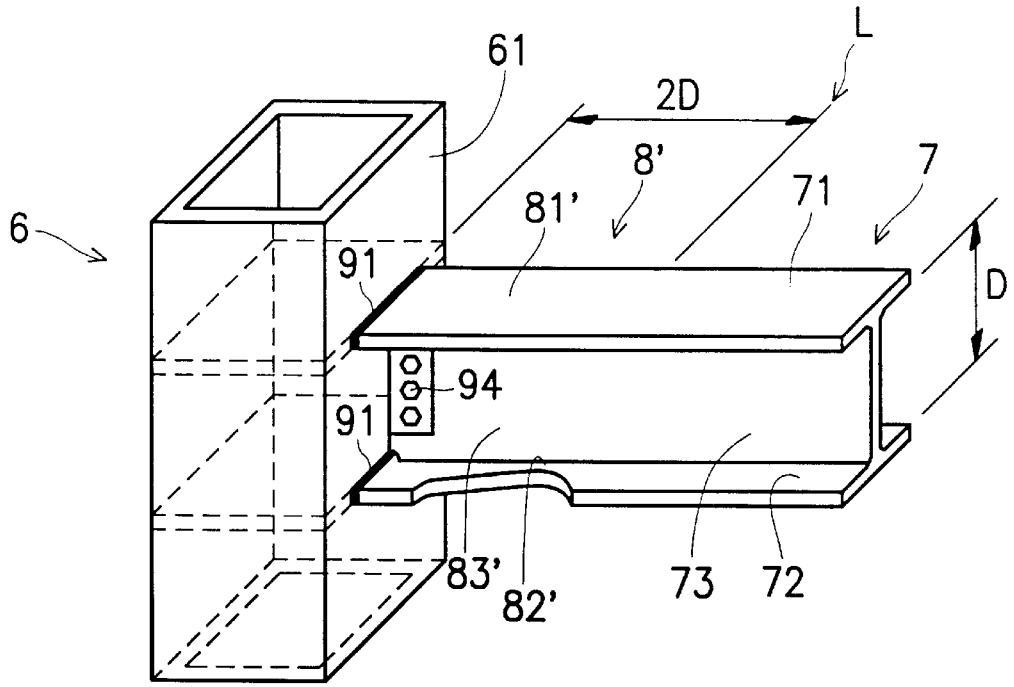
FIG. 8 is a perspective diagram of an H-beam connected to a box-column through a beam-to-column connection according to a second embodiment of this invention.
Figure 9:
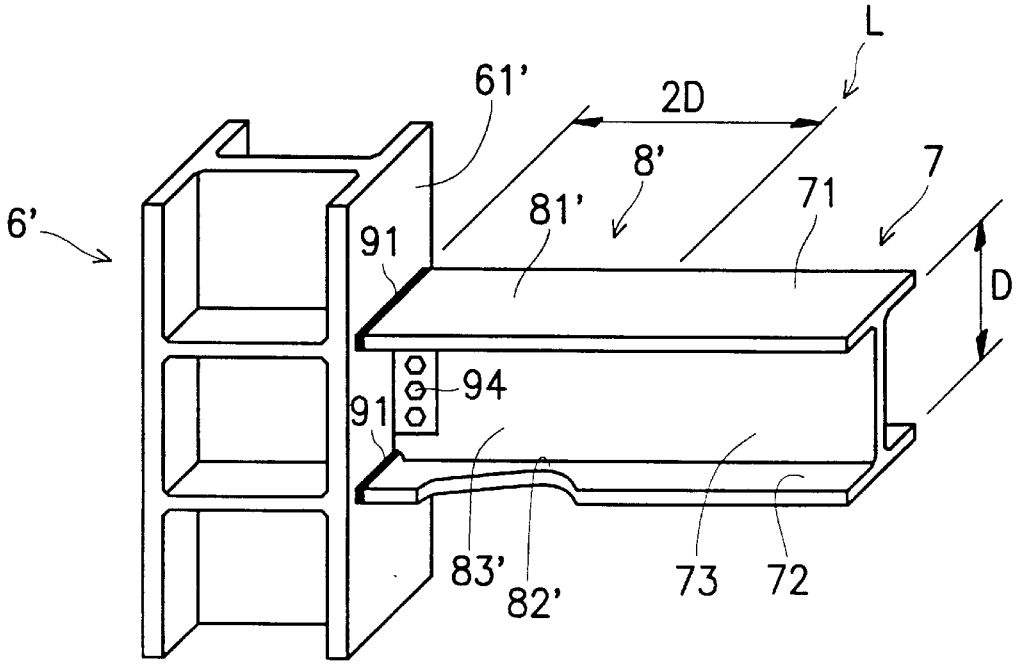
FIG. 9 is a perspective diagram of an H-beam connected to an H-column through a beam-to-column connection according to an alternative second embodiment of this invention.

FIG. 8 shows a second embodiment of this invention, wherein another connection 8' is connected between the H-beam 7 and the box-column 6. The connection 8' has a web plate member 83' and two flange plate members 81', 82'. It is noted that the lower flange plate member 82' of the connection 8' is trimmed to form a tapered zone. Also, the tapered zone is formed within a region, same as that in the first embodiment, which is defined between the column surface 61 and the line L parallel to and apart from the column surface 61 at about a distance 2D. FIG. 9 shows the connection 8' is connected to an H-column 6'.

Figure 10:
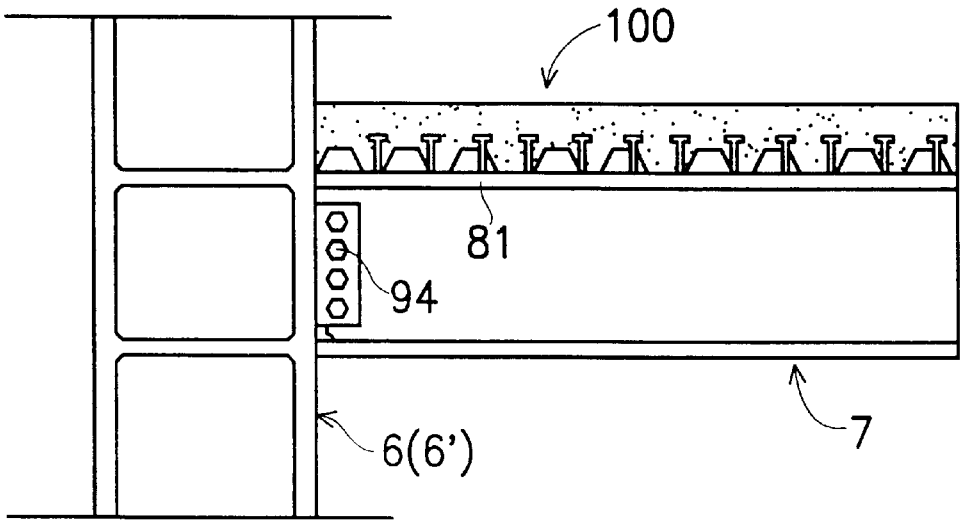
FIG. 10 is a schematic diagram of a beam and column of existing structures.
Figure 11:
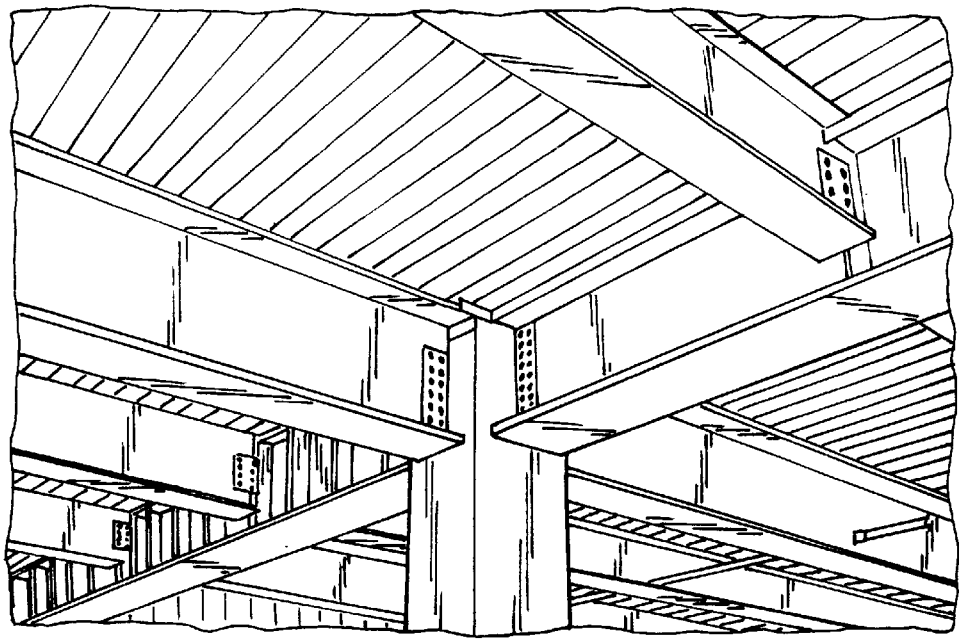
FIG. 11 is a bottom view of a concrete floor.
Figure 12:
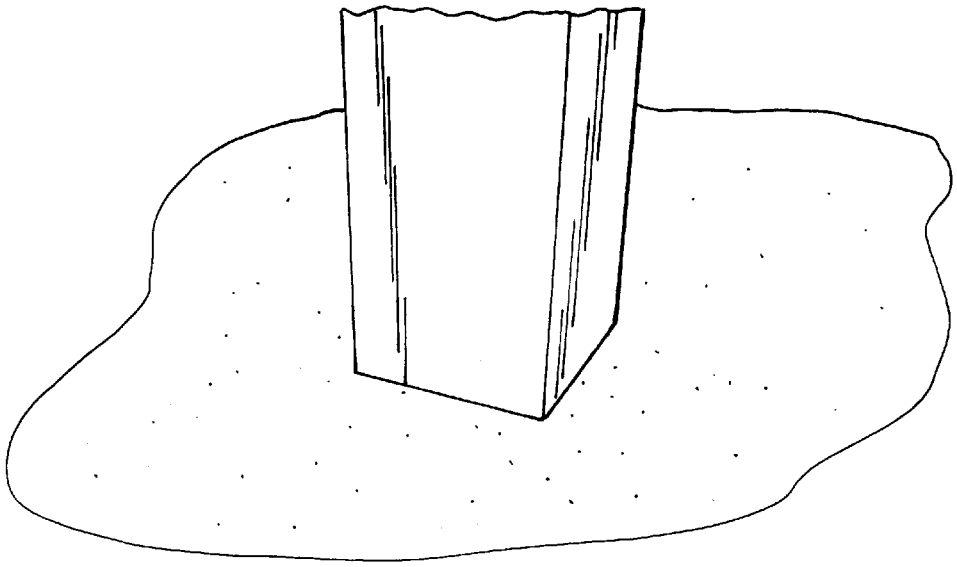
FIG. 12 is a top view of the concrete floor in FIG. 11.

Both the first and second embodiments can be practiced in new structures. The practice of the second embodiment is particularly suitable for existing structures because the upper flange plate member 81 is covered by a concrete floor 100, as shown in FIG. 10. If the first embodiment is practiced in existing structures, the concrete floor 100 needs to be struck and removed before the upper flange plate member 81 is trimmed. FIG. 11 is a bottom view of a concrete floor. FIG. 12 is a top view of the concrete floor.

Although this invention has been described in its preferred forms and various examples with a certain degree of particularity, it is understood that the present disclosure of the preferred forms and the various examples can be changed in the details of construction. The scope of the invention should be determined by the appended claims and not by the specific examples given herein.

What is claimed is:

1. An apparatus for connecting an H-beam to a column surface, the apparatus comprising:

an H-beam having a pair of flange plates and a web plate positioned between the flange plates, a plastic moment capacity and a demand moment capacity;

a web plate member disposed at an end of the H-beam integrally formed with the web plate of the H-beam; and a pair of flange plate members also disposed at the end of the H-beam and respectively integrally formed with the flange plates, one of the flange plate members having a tapered zone that is non-uniform in width, the plastic moment capacity of the H-beam in the non-uniform tapered zone being reduced as a result of the non-uniform width to an amount of about 90%–95% of the demand moment capacity of the H-beam.

2. The apparatus of claim 1, wherein the H-beam has a depth D, and the web plate member and the pair of flange plate members have a length that is at most equal to approximately 2D.

3. The apparatus of claim 1, wherein each of the pair of flange plates is substantially uniform in width.

4. An H-beam comprising a web plate connected to a pair of flange plates, each of the flange plates having a width, the H-beam having a plastic moment capacity, a demand moment capacity and, at an end of the H-beam, a region having a tapered zone of non-uniform width in one of the flange plates, the plastic moment capacity of the H-beam in the non-uniform tapered zone being reduced as a result of the non-uniform width to about 90%–95% of the demand moment capacity of the H-beam.

5. The H-beam as claimed in claim 4, wherein the H-beam has a depth D and the tapered zone is formed within a distance 2D from the end of the H-beam.

6. An H-beam comprising a web plate connected to a pair of flange plates, each of the flange plates having a width, the H-beam having a plastic moment capacity, a demand moment capacity and, at-an end of the H-beam, a region having a tapered zone of non-uniform width in one of the flange plates, wherein the H-beam has a depth D and the tapered zone is formed within a distance 2D from the end of the H-beam, and the width of the flange decreases in the tapered zone in a direction away from the end of the H-beam, the plastic moment capacity of the H-beam in the non-uniform tapered zone being reduced as a result of the non-uniform width to an amount of about 90%–95% of the demand moment capacity of the H-beam.

7. An apparatus comprising:

an H-beam having a pair of flange plates and a web plate positioned between the flange plates, the H-beam having a plastic moment capacity and a demand moment capacity;

a web plate member disposed at an end of the H-beam and integrally formed with the web plate of the H-beam; and a pair of flange plate members also disposed at the end of the H-beam and respectively integrally formed with the flange plates, one of the flange plate members having a tapered zone that is non-uniform in width, the plastic moment capacity of the H-beam in the non-uniform tapered zone being reduced as a result of the non-uniform width to an amount of about 90%–95% of the demand moment capacity of the H-beam;

wherein the flange plate member with the tapered zone increases in width in a portion of the tapered zone and decreases in width in another portion of the tapered zone in a direction away from the end of the H-beam.

* * * * *